United States Patent [19]

Staub, Jr. et al.

[11] 4,358,773

[45] Nov. 9, 1982

[54] ANTENNA FOR TELEVISION RECEPTION

[76] Inventors: John T. Staub, Jr.; Lucy A. Staub, both of 302 E. Joppa Rd., Towson, Md. 21204

[21] Appl. No.: 236,770

[22] Filed: Feb. 23, 1981

[51] Int. Cl.[3] ..... H01Q 9/28

[52] U.S. Cl. ..... 343/896

[58] Field of Search ..... 343/895, 896, 908

[56] References Cited

U.S. PATENT DOCUMENTS 2,613,319 10/1952 Lisbin ..... 343/895

2,682,608 6/1954 Johnson ..... 343/895

3,641,580 2/1972 Menser ..... 343/895

4,014,028 3/1977 Cone ..... 343/895

*Primary Examiner*—Eli Lieberman

*Attorney, Agent, or Firm*—John F. McClellan, Sr.

[57] ABSTRACT

An omnidirectional antenna for TV reception and the like has a dielectric semi-circular frame with a central aperture in the diametral portion and a succession of equally spaced notches in the circumferential arc around which a plurality of loops of a continuous length of twin-lead wire are coiled in a substantially random sequence, yielding advantages superior in more than one respect to conventional "rabbit ears" type antenna.

6 Claims, 3 Drawing Figures

ANTENNA FOR TELEVISION RECEPTION

FIELD OF THE INVENTION

This invention relates generally to electromagnetic wave transmission equipment and specifically to an improved antenna for television reception.

BACKGROUND OF THE INVENTION

In the prior art various antennae with convolutions have been disclosed including those in the following U.S. patents:

U.S. Pat. No. 2,613,319 granted to D. M. Lisbin et al on Oct. 7, 1952, disclosed a dipole antenna for television use in the form of two spirals with bases opposed and held by an insulative base;

U.S. Pat. No. 2,682,608 granted to E. O'E Johnson, June 29, 1954, disclosed an antenna in the form of a twin lead opposed-helix structure with spacing change along the length from each end towards the center;

U.S. Pat. No. 3,641,580 granted to C. J. Memer on Feb. 8, 1972, disclosed another form of multiple-loop antenna;

U.S. Pat. No. 4,014,028 granted to J. A. Cone et al, on Mar. 22, 1977, disclosed an interlaced helix antenna.

OBJECTS OF THE INVENTION

A principal object of this invention is to provide a new antenna for television reception and the like which at any azimuthal position provides a surprising improvement in weak-signal television set performance as compared with conventional "rabbit ears", regardless of the adjustment of the rabbit ears.

Further objects are to provide an antenna as described which is compact and omnidirectionally efficient, easy to attach and adaptable to more installations than "rabbit ears" antenna, light in weight, economical to make and to purchase, safe, and strikingly handsome in appearance.

BRIEF SUMMARY OF THE INVENTION

In brief summary given as cursive description only and not as limitation, the invention includes an antenna of twin-lead continuously deployed in adjacent elliptical loops about a "U" shaped axis from a first substantially horizontal loop through a series of similar-size loops ascending in random adjacency to substantially vertical central loops and then descending similarly to a second horizontal loop.

BRIEF DESCRIPTION OF THE DRAWINGS

The above and other objects and advantages of this invention will become more readily apparent on examination of the following description, including the drawings, in which like reference numerals refer to like parts.

DETAILED DESCRIPTION OF THE DRAWINGS

Figure 1:
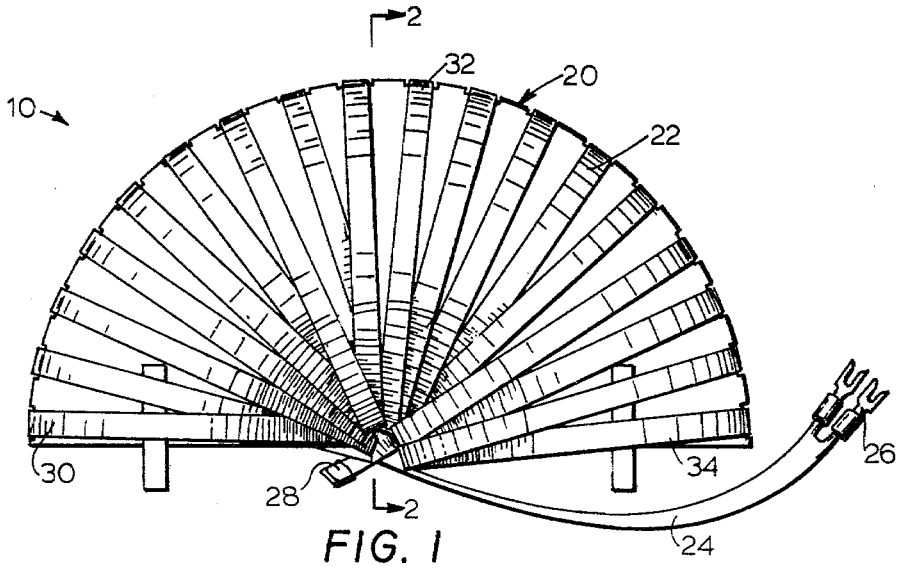
FIG. 1 is a perspective view of the invention.

FIG. 1 shows the typical overall configuration of the invention 10 which includes a frame 20 having attached thereon in coiled configuration a continuous length of 300 ohm flat twin-lead conductor or television antenna hook-up wire 22.

A length 24 of the twin-lead extends from the coiled portion a distance convenient for attachment to a conventional television set antenna screw-connection and preferably terminates in spade lugs 26 or the like for this purpose, at this first end.

The second end 28 of the twin lead has the leads isolated (simply cut-off and preferably taped) to prevent any electrical circuit from being accidentally closed between the twin leads at the second end.

Between these ends the loops lie at regular angles, from horizontal at 30 through upright, at 32, to horizontal at 34, describing a "U" shaped axis. "A description of the path which the various loops follows is elliptical with a combined 180 degree confined-expanded position alternately fixed upon a web for support", in the inventor's words.

Figure 2:
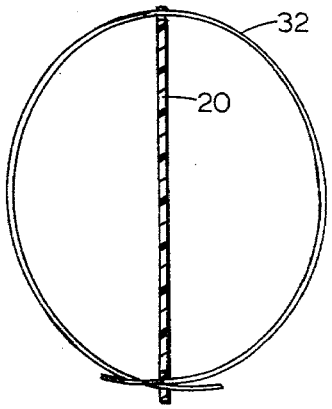
FIG. 2 is a view taken at 2—2, FIG. 1.

FIG. 2 shows that typically each individual loop 32 indicated is elliptical in axial view.

Figure 3:
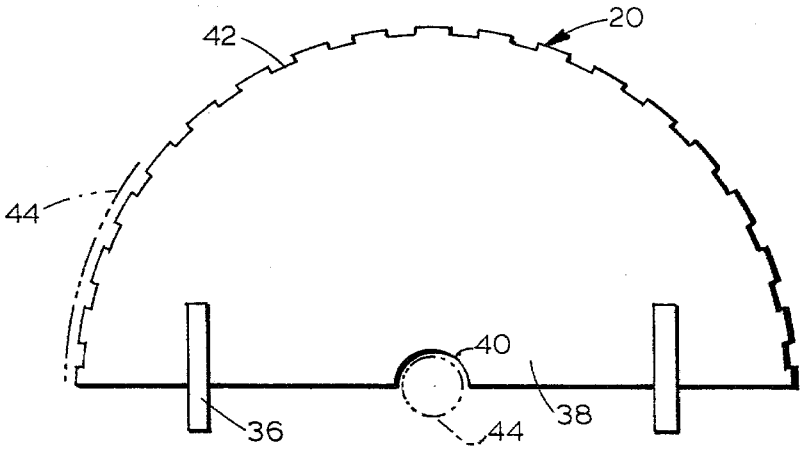
FIG. 3 is a partially schematic detail of a frame portion of the invention.

FIG. 3 shows the frame 20 as comprising dielectric feet 36 supporting upright a dielectric web 38 (plastic or the like) of semicircular shape having the diametral edge horizontal at the bottom, and with a similarly shaped, corresponding aperture 40 at the bottom center for retaining the compressed portions of the loops. The feet are slotted plastic blocks, or the like.

In regular spacing around the circular perimeter portion the web has configuration defining a plurality of notches 42 for supporting respective loops wound from the aperture 40 out around a notch, back around the aperture and so forth.

Although not fully understood, it is believed that the surprisingly superior performance of the invention 10 may derive in part from the novel sequence of winding. Winding is not in regular succession but instead is random within each half, or quarter circle of the web.

In winding, the typically flat twin lead configuration is not twisted but instead all loops in the helix are similar in configuration and in size. In the model tested the winding sequence was as follows, assuming the left hand notch to be numbered "1" and the notches numbered in regular succession through to the right hand notch "18": 11, 17, 18, 16, 14, 15, 12, 13, 10, 9, 8, 7, 5, 3, 2, 6, 4. Eighteen loops of 5 15/16 inches (15 cm) major diameter and of 4 inches minor (10 cm) gave the surprising results achieved.

The web 38 in FIG. 3 may be of 6 inches (151 mm) radius, 12 inch (302 mm) in diameter and rim notches just sufficient to fit the cross-section of the conventional plastic covered twin lead.

Cloth tape 44 (phantom lines) looped around the coils and second end at aperture 40 secures them and similarly a length of the tape 44 (fragment indicated) may be adhered around the perimeter for doubly securing the loops in the notches 42.

In testing, the invention was selectively connected to a black-and-white "General Electric" table model seventeen-inch-screen television set, through a three-way selector switch. Selectively connected through the three way switch also was a "rabbit ear" type antenna of base supporting two arms adjustably orientable in spacing and in azimuth and telescopically extendable from $15\frac{3}{4}$ to $35\frac{3}{4}$ inches in length. Finally, the three way switch was at one position connected to no antenna, thus giving the choice of two antenna inputs and a null input.

Both when tested in a steel frame, steel panelled room, "looking" out toward the transmission source through a glass front, and when tested in a building of more conventional construction, the invention gave substantially superior video reception on weak-signal channels. Those channels in which this strikingly appeared included Channels 2, 11, 13 in Baltimore.

Surprisingly, also, and not completely understood was the omnidirectional effect of the invention, which was equally effective in all azimuths as contrasted with the adjustment-dependent performance of the "rabbit-ears" antenna. From the above it will be appreciated that the invention can be used in a more confined space and can provide consistently improved reception from stations located in more widespread areas than the "rabbit ears" antenna, and without necessity for re-orientation when the channel is changed to broadcast sources located in various directions.

The extreme economy of the invention will be appreciated from the lightweight and uncomplicated construction using a maximum of readily available material, the twin-lead conductor, and the simple planar notched web supported on feet.

This invention is not to be construed as limited to the particular forms disclosed herein, since these are to be regarded as illlustrative rather than restrictive. It is, therefore, to be understood that the invention may be practiced within the scope of the claims otherwise than as specifically described.

What is claimed and desired to be protected by United States Letters Patent is:

1. In an antenna having a frame, including means for holding the frame upright and wire coiled on the frame, the improvement comprising: said wire being flat twin-lead conductor, said frame being of dielectric material in semi-circular shape, and the wire coiling forming a plurality of similar-size and similar configuration loops with each loop passing around a central lower portion of the semicircular shape and then around a respective one of a plurality of equally spaced locations on the circular periphery of the frame.

2. In an antenna as recited in claim 1, said coiling being in random succession within each quarter circular portion of the semi-circular shape.

3. In an antenna as recited in claim 1, the twin-lead conductor having a first end with means for connecting each of said twin leads to a television receiver, and a second end with each of said twin leads isolated.

4. In an antenna as recited in claim 2, said central lower portion comprising structure defining an aperture for holding therein said loop passing therearound.

5. In an antenna as recited in claim 2, each of said plurality of equally spaced locations being a notched configuration in the frame.

6. In an antenna as recited in claim 2, the means for holding said frame upright comprising at least one foot composed of dielectric material.

* * * * *